United States Patent [19]

Anzai et al.

[11] 4,209,082

[45] Jun. 24, 1980

[54] ELEVATOR CONTROL APPARATUS

[75] Inventors: Nobuo Anzai; Eiki Watanabe, both of Inazawa, Japan

[73] Assignee: Mitsubishi Denki Kabushiki Kaisha, Tokyo, Japan

[21] Appl. No.: 807,640

[22] Filed: Jun. 17, 1977

[30] Foreign Application Priority Data

Jul. 6, 1976 [JP] Japan ..... 51/80104

[51] Int. Cl.[2] ..... B66B 5/02

[52] U.S. Cl. ..... 187/29 R

[58] Field of Search ..... 187/29; 361/15, 23, 361/33; 363/57, 58, 129; 318/380

[56] References Cited

U.S. PATENT DOCUMENTS

| | | | |
|---|---|---|---|
| 3,611,092 | 10/1971 | Willmunder | 318/380 X |
| 3,697,845 | 10/1972 | Soffer et al. | 318/380 X |
| 3,749,204 | 7/1973 | Caputo | 187/29 |
| 3,947,748 | 3/1976 | Klein | 363/57 |
| 4,058,696 | 11/1977 | Antier et al. | 363/57 X |

*Primary Examiner*—J. V. Truhe
*Assistant Examiner*—W. E. Duncanson, Jr.
*Attorney, Agent, or Firm*—Oblon, Fisher, Spivak, McClelland & Maier

[57] ABSTRACT

An elevator control apparatus comprises a thyristor power rectifier connected to an AC power source and for driving a DC motor for cage drive; a power stoppage detector for detecting the power stoppage of the AC power source; and a series circuit including a capacitor and switching connected in series with the capacitor. The series circuit is connected across the thyristor power rectifier. Before a cage starts its travel, the capacitor is charged through the thyristor power rectifier, with the polarity which depends on the traveling direction of the cage. At the power stoppage, the capacitor is discharged through the thyristor power rectifier, in response to a switching operation of the switching element.

1 Claim, 3 Drawing Figures

ELEVATOR CONTROL APPARATUS

BACKGROUND OF THE INVENTION

The invention relates to an elevator control apparatus and, more particularly, to the one using the thyristor-Leonard system.

With a remarkable progress of semi-conductor devices, the so-called thyristor-Leonard system has been prevailingly used for the control apparatus of an elevator system using a DC motor for the cage drive.

When the thyristor-Leonard system operates in the regenerative braking mode, current flows into the thyristor power rectifier and the AC power source, as is well known. In the regenerative braking mode, if power stoppage occurs, a voltage developed in the armature of the DC motor causes a current flow. At this time, the thyristor power rectifier is made ineffective in its function of control so that the current grows rapidly to be excessive one. This excessive current possibly gives a shock to the passengers in the cage or frequently damages the thyristors in the power rectifier. The conventional system is so designed as to detect the power stoppage and shut off such an excessive current. A relatively long time, e.g. 50 to 100 milli-seconds, is necessary for the shutting-off of the excessive current by the conventional one, however.

SUMMARY OF THE INVENTION

Accordingly, the primary object of the invention is to provide an elevator control apparatus which does not shock the passengers in the cage and further does not damage the thyristor power rectifier.

According to one important feature of the invention, there is provided an elevator control apparatus comprising:a thyristor power rectifier connected to an AC power source and for driving a DC motor for cage drive; a power stoppage detector for detecting the power stoppage of the AC power source; and a series circuit including a capacitor and switching elements connected in series with the capacitor. The series circuit is connected across the thyristor power rectifier. Before a cage stats its travel, the capacitor is charged through the thyristor power rectifier, with the polarity which depends on the traveling direction of the cage. At the power stoppage, the capacitor is discharged through the thyristor power rectifier, in response to a switching operation of the switching element.

Other objects and features of the invention will be apparent from the following description taken in connection with the accompanying drawings, in which:

DESCRIPTION OF THE PREFERRED EMBODIMENTS

Figure 1:
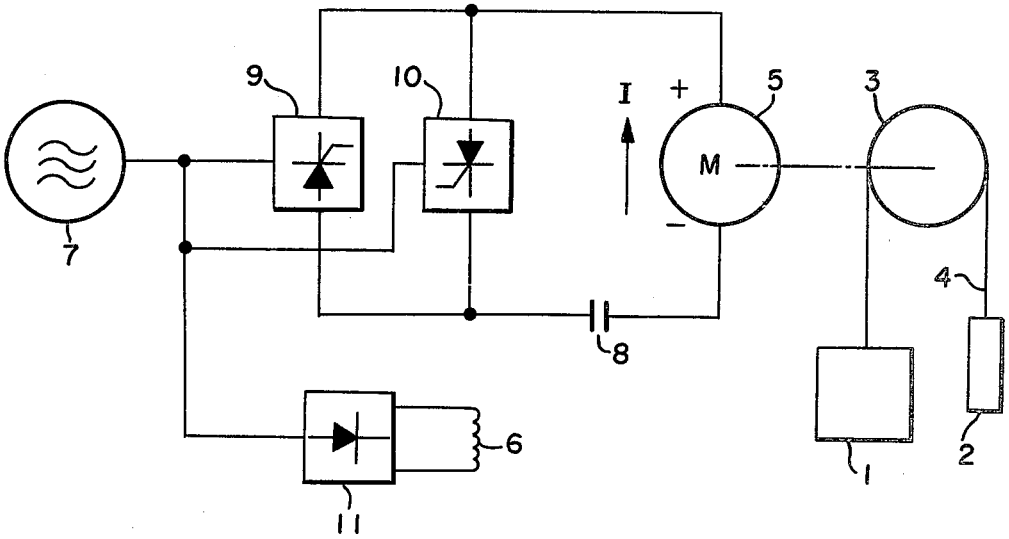
FIG. 1 shows in block form a conventional elevator control apparatus.

Before proceeding with the description of the embodiments of the invention, the conventional elevator control apparatus will be described with reference to FIG. 1, for a better understanding of the invention. In FIG. 1 illustrating a circuit construction of an elevator control apparatus employing the thyristor-Leonard system, reference numeral (1) designates a cage of an elevator, (2) a counter-weight, (3) a driving sheave for a traction machine, (4) a main rope, (5) an armature of a DC motor for driving the driving sheave, (6) a field coil of the same, (7) a three-phase AC power source, (8) a normally open contact of a contactor (not shown) of a main circuit, (9) and (10) thyristor banks and (11) diode.

Assume now that a voltage developed in the motor (5) takes the polarity as shown in the figure and the current in the main circuit likewise takes the polarity as shown in the figure. This circuit condition indicates the so-called regenerative braking operation of the elevator control system of this type. It is well known that this operational mode takes place when the cage (1) descends with the load in the cage being heavier than the counter-weight (2), or inversely when the empty cage (1) ascends. In this case, the current flows through a path (5)-(10)-(7)-(10)-(8)-(5). When power stoppage accidentally occurs, the thyristor power rectifier is incapacitated from its control function. For this, the current increases to the value determined by the counter electromotive force developed in the motor (5) and the impedance of the circuit. The impedance of the circuit is extremely small so that the current flowing therethrough grows remarkably large. This excessively grown current possibly gives a great shock to the passengers in the cage (1) or frequently damages the thyristor power rectifier (10). In this conventional system, at the power stoppage, the contactor of the main circuit is deenergized after occurence of the power stoppage and its associated contact (8) is opened to shut off the short-circuiting current. 50 to 100 milli-seconds, however, must be taken for the open of the contact (8). For this period of time, the short-circuiting current becomes extremely large, giving various adverse effects.

Figure 2:
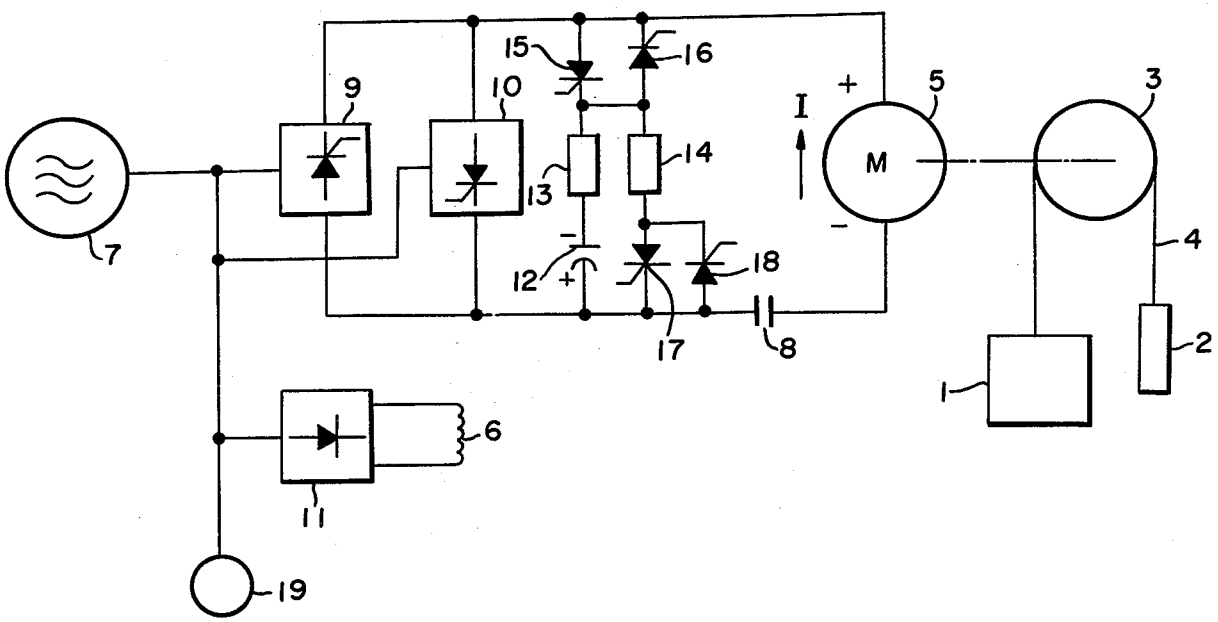
FIG. 2 is a schematic circuit diagram of an embodiment of an elevatorcontrol apparatus according to the invention.

Referring now to FIG. 2, there is shown an embodiment of an elevator control apparatus of the invention. In the figure, reference numeral (12) designates a capacitor, (13) and (14) resistors, (15) to (18) thyristors, and (19) a power stoppage detector.

In an elevator system of which the motor (5) develops a voltage with the polarity as shown in the figure in lifting opeartion of the cage (1), it can be checked to see whether the traveling direction of the cage (1) to be traveled is the lifting or lowering one, before the cage starts. The cage (1) is now assumed to travel in the lifting direction. A firing pulse is delivered to the thyristor power rectifier (10) and to the thyristor (16). Before starting of the cage, the contact (8) of the main circuit contactor is open so that the capacitor (12) is charged with the polarity as shown in the figure. The resistor (13) serves to restrict this charging current and its value is relatively small. The resistor (13) may be omitted if the charging current is gradually increased. When the capacitor (12) is charged to a desired value, the pulse directed to the thyristor power rectifier (10) is stopped and then the contact (8) of the main circuit contactor is closed to start traveling of the cage (1).

Let us consider now the case where power stoppage takes place under this condition. In the regenerative operational mode, the thyristor power rectifier (10) is fired. When the power stoppage occurs, the power stoppage detector (19) instantly detects it and firing pulses are delivered to the thyristors (15) to (18). As the power stoppage occurs, it makes it impossible to effect the commutation of the thyristor power rectifier, thus permitting the short-circuiting current to flow therethrough. Nevertheless, the voltage due to the charges stored in the capacitor (12) is applied, as an inverse bias voltage, to the thyristor power rectifier (10) and, hence, the thyristor power rectifier (10) is extinguished or turned off. After extinction of the thyristor power rectifier (10), the current flows through a path (5)-(15)-(14)-(17) -(5). If the value of the resistor (14) is properly selected, the current may be restricted to be below an emergency braking current, thus little shocking the passengers. Incidentally, in the power running of the elevator, as the power stoppage occurs, the thyristor power rectifier is instantaneously turned off so that this circuit of the thyristor power rectifier brings about no adverse effect.

The description of the operation of the cage traveling in the reverse direction will be omitted since it will be easily estimated from the foregoing description.

Figure 3:
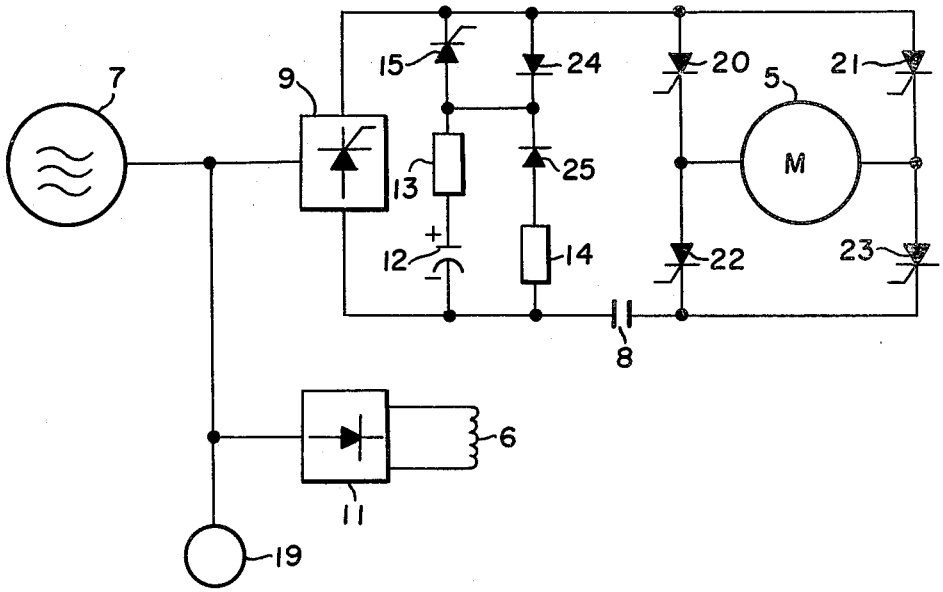
FIG. 3 shows a schematic circuit diagram of another embodiment of the elevator control apparatus according to the invention.

FIG. 3 shows another embodiment of the elevator control apparatus that the present invention is applied to the armature switching type thyristor-Leonard system. In the figure, (20) to (23) designate thyristors and (24) and (25) diodes. In the power running, the thyristors (20) and (23), for example, are turned on or fired while, in the regenerative braking mode, the thyristors (21) and (22) are turned on. As in the FIG. 2 case, when the power stoppage takes place, charges stored in the capacitor (12) inversely biases the thyristor power rectifier (9) to be turned off.

As described above, in the present invention, before start of the cage, the capacitor is previously charged with such a polarity as to inversely bias the thyristor power rectifier into which the regenerative current is made to flow and, at the power stoppage, the capacitor is discharged through the thyristor power rectifier. Therefore, the invention may prevent failure of the commutation of the thyristor power rectifier even if the power stoppage occurs in the regenerative braking mode.

What is claimed is:

1. An elevator control apparatus comprising: a thyristor power rectifier connected to an AC power source and for driving a DC motor for cage drive;

a power stoppage detector for detecting the power stoppage of the AC power source; and a circuit including a capacitor and switching elements connected with said capacitor, said circuit being connected across said thyristor power rectifier, wherein, before a cage starts its travel, said capacitor is charged through said thyristor power rectifier, with the polarity which depends on the traveling direction of the cage and, at the power stoppage, said capacitor is discharged through said thyristor power rectifier, in response to a switching operation of said switching elements, to inversely bias said thyristor power rectifier and to thereby turn it off; said switching elements being connected across said thyristor power rectifier to form at least two opposing current paths for regenerative current delivered from said DC motor, and each of said two opposing current paths having at least two thyristors connected therein;

said circuit further including a resistive impedance for restricting the regenerative current delivered from said DC motor when power stoppage occurs in the regenerative braking mode.

* * * * *